United States Patent [19]

White

[11] Patent Number: 4,501,187

[45] Date of Patent: Feb. 26, 1985

[54] VERTICAL LAUNCH ALIGNMENT TRANSFER APPARATUS

[75] Inventor: Harold V. White, Huntsville, Ala.

[73] Assignee: The United States of America as represented by the Secretary of the Army, Washington, D.C.

[21] Appl. No.: 470,749

[22] Filed: Feb. 28, 1983

[51] Int. Cl.[3] ..... F41G 3/02

[52] U.S. Cl. ..... 89/1.8; 89/41 EA; 244/3.1

[58] Field of Search ..... 89/1.8, 1.816, 1.819, 89/41 E, 41 EM; 244/3.1, 3.16

[56] References Cited

U.S. PATENT DOCUMENTS 3,225,655 12/1965 Inglis ..... 89/1.816

3,941,345 3/1976 Stripling ..... 244/3.1

4,146,196 3/1979 Schultz ..... 244/3.1

4,307,650 12/1981 Kuesters et al. ..... 89/1.816 X 4,409,468 10/1983 Mayer et al. ..... 89/41 E 4,410,151 10/1983 Höppner et al. ..... 89/1.819 X

*Primary Examiner*—David H. Brown

*Attorney, Agent, or Firm*—Anthony T. Lane; Robert P. Gibson; Harold W. Hilton

[57] ABSTRACT

Apparatus for transferring azimuth alignment with modest accuracy to the guidance systems of individual missiles in a pod configured for vertical launch. The apparatus includes a mechanical interface between two rods (attached to the missile and oriented to the missile's guidance system) and two v-groove elements (attached to the launch tube and oriented to a northfinder mounted on the pod).

3 Claims, 3 Drawing Figures

VERTICAL LAUNCH ALIGNMENT TRANSFER APPARATUS

DEDICATORY CLAUSE

The invention described herein may be manufactured, used, and licensed by or for the Government for governmental purposes without the payment to me of any royalties thereon.

SUMMARY OF THE INVENTION

A launch mechanism for vertically launching missiles carried in launch tubes disposed in a pod. The launch mechanism includes apparatus for transferring azimuth with modest accuracy to guidance systems of individual missiles vertically carried in the launch tubes. A northfinder is mounted on the pod and v-groove elements are secured in the launch tubes and oriented to the northfinder. Rods are secured on opposite sides of each missile and are oriented to the guidance system of each missile. The missiles are positioned in the launch tubes with the rods positioned in the v-grooves.

DESCRIPTION OF THE PREFERRED EMBODIMENT

Figure 1:
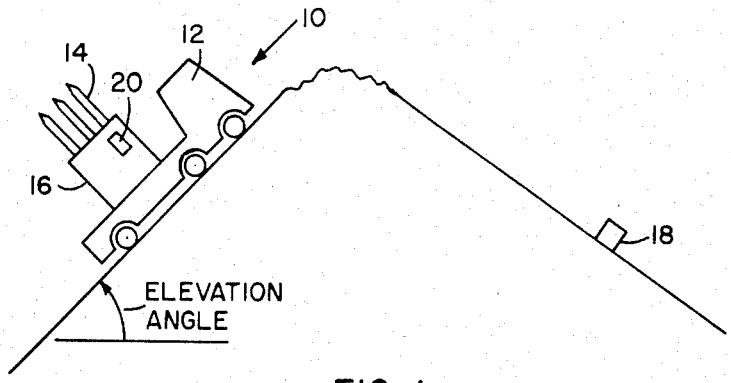
FIG. 1 is a pictorial view of a vertical launch scenario using apparatus of the present invention.

Apparatus for transferring azimuth alignment with modest accuracy to guidance systems of individual missiles in a pod configured for vertical launch. The apparatus 10 includes a mobile launcher 12 having a launch pod 16. The missiles can be launched from inclinations of up to 45 degrees in the known directions of a target 18. A northfinder 20 is secured to pod 16.

Figure 2:
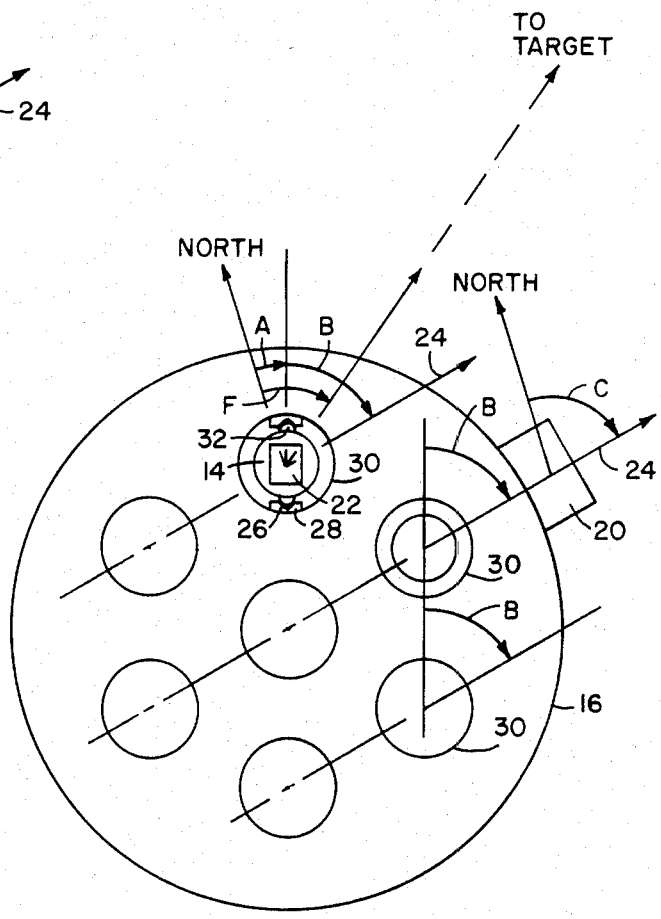
FIG. 2 is a top view of the launch pod of the present invention.

FIG. 2 is a plan view of launch pod 16 having vertically oriented missiles 14 therein. Azimuth direction of the missile guidance systems, illustrated by the numeral

22, must be determined before aiming can be completed. This is done in the following manner.

The northfinder 20 determines the heading from north C of a reference line 24 which is fixed relative to v-grooves 26 in a member 28 secured in launch tubes 30 of pod 16. B is the fixed angle between the reference line 24 and v-grooves 26. Heading information is transferred from the northfinder 20 via the v-grooves 26 and rods 32 to the missile guidance system 22, to give the missile heading angle A. F is the known angle between north direction and the target 18.

Figure 3:
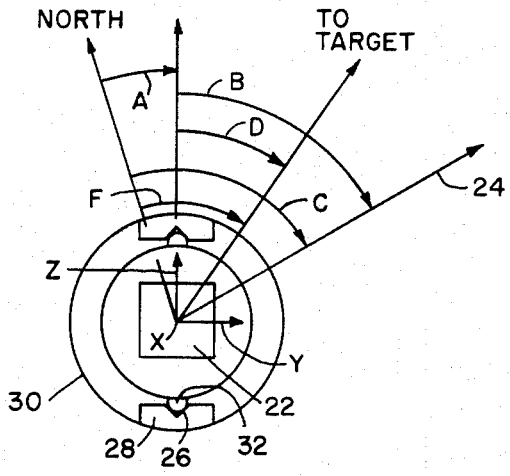
FIG. 3 illustrates the angle relationship for transfer of azimuth alignment between a northseeker mounted on the pod and individual missiles carried therein.

Angle relationships are further illustrated in FIG. 3 from which it is seen that the aiming angle D is given as $$D=F-A$$

This relationship defines the angle between the guidance system X, Z plane and the plane containing launch point and target $$A=C-B$$

C is obtained from the northfinder and B is the fixed angle between v-grooves 16 and northfinder reference line 24.

After launch, other missiles can be loaded into the launch tubes 30 using the v-grooves 26 and rods 32 to again transfer azimuth alignment.

I claim:

1. A vertical launch alignment transfer apparatus comprising:

a. a vehicle having a launch pod thereon, said launch pod provided with a plurality of launch tubes having missiles therein;

b. a northfinder carried on said pod; and, c. mechanical interface means including a first means attached to the missile and oriented to the guidance system of said missile and a second means attached to said launch tube and oriented to said northfinder whereby azimuth alignment is transferred to the guidance system of individual missiles in said pod.

2. Apparatus as in claim 1 wherein said first means is a rod carried on opposite sides of said missile.

3. Apparatus is in claim 2 wherein said second means is a pair of elements oppositely disposed in said launch tubes, said elements having a v-groove therein to receive said rods.

* * * * *